US006029817A

United States Patent [19]

Wilson, Jr.

[11] Patent Number: 6,029,817

[45] Date of Patent: Feb. 29, 2000

[54] LIGHTWEIGHT, RECYCLABLE ISOLATION PACKING FOR DELICATE ITEMS

[75] Inventor: Robert James Wilson, Jr., Macedon, N.Y.

[73] Assignee: Harris Corporation, Melbourne, Fla.

[21] Appl. No.: 09/163,745

[22] Filed: Sep. 30, 1998

Related U.S. Application Data

[60] Provisional application No. 60/060,440, Sep. 30, 1997.

[51] Int. Cl.[7] ..... B65D 85/48

[52] U.S. Cl. ..... 206/453; 206/586

[58] Field of Search ..... 206/453, 521, 206/586, 527, 486; 229/115

[56] References Cited

U.S. PATENT DOCUMENTS

| | | | |
|---|---|---|---|
| 2,507,929 | 5/1950 | Pennebaker | 206/586 |
| 2,663,417 | 12/1953 | Kincaid | 206/586 |
| 2,750,032 | 6/1956 | Laird | 206/453 |
| 2,776,745 | 1/1957 | Van Antwerpen | 206/586 |
| 3,043,488 | 7/1962 | Warwick | 206/586 |
| 4,951,821 | 8/1990 | Kempkes | 206/586 |
| 4,951,823 | 8/1990 | Butkus et al. | 206/586 |
| 5,005,705 | 4/1991 | Combs | 206/586 |
| 5,447,233 | 9/1995 | Smith | 206/586 |

*Primary Examiner*—David T. Fidei
*Attorney, Agent, or Firm*—Tarolli, Sundheim, Covell, Tummino & Szabo L.L.P.

[57] ABSTRACT

An apparatus for protecting an article. The apparatus is a single sheet of material that is folded to define a saddle portion recessed between two extending portions. The protected article is extendible into the saddle area. The two extending portions of the apparatus are defined by planar portions that form a triangular area when viewed from the side. The saddle area is defined by two triangular elements when viewed from the side, and which are defined by planar portions.

11 Claims, 10 Drawing Sheets

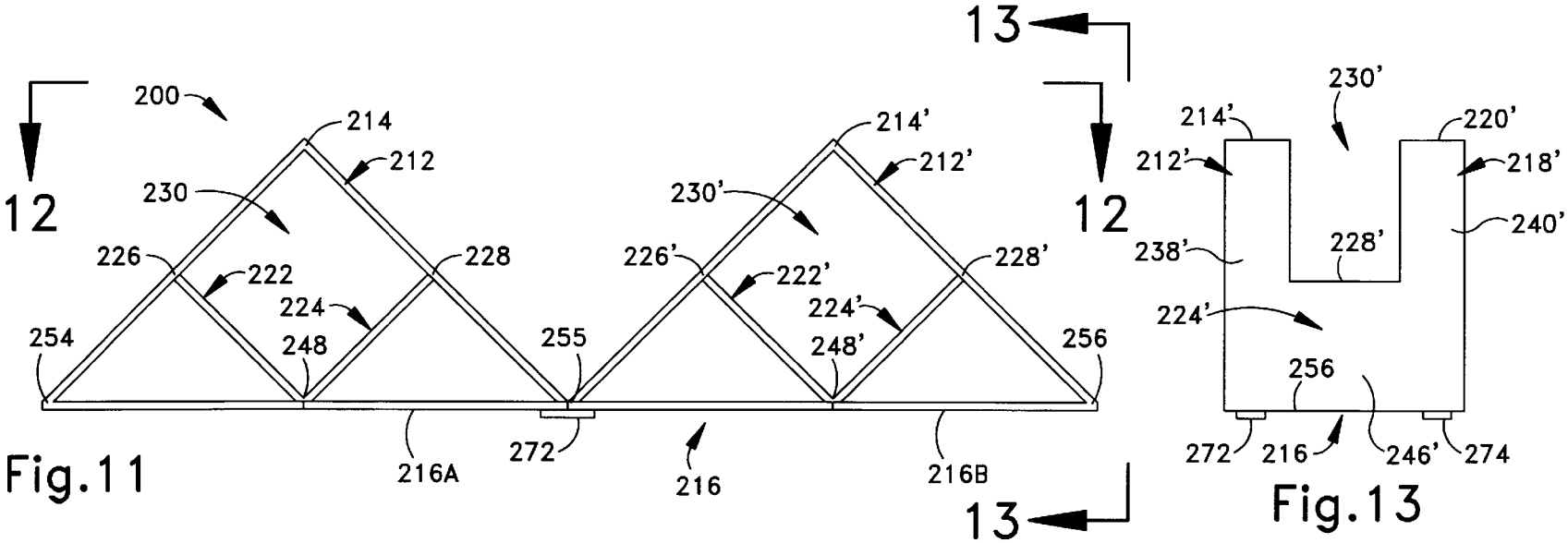
Fig.11
Fig.13
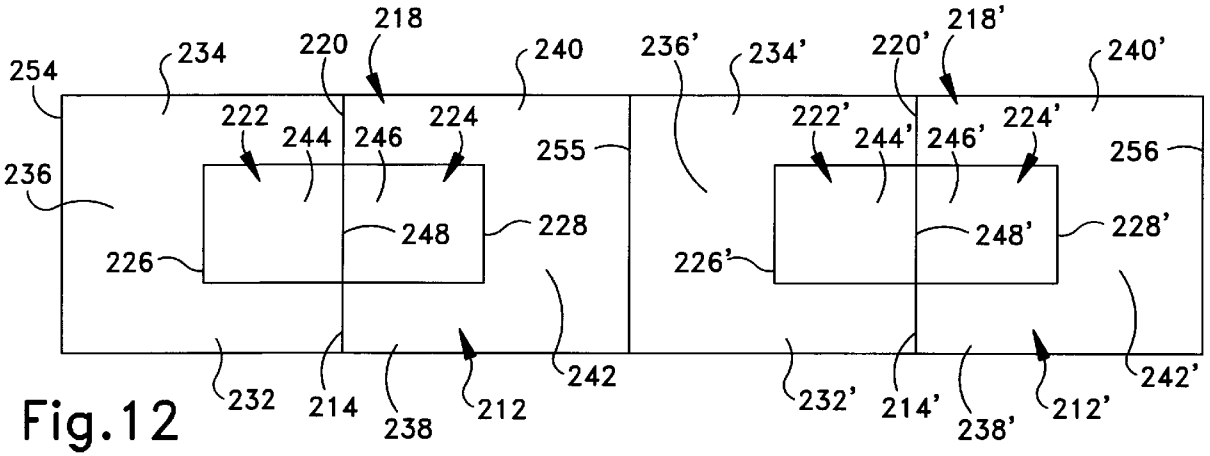
Fig.12

LIGHTWEIGHT, RECYCLABLE ISOLATION PACKING FOR DELICATE ITEMS

RELATED APPLICATION

This application claims benefit of U.S. Provisional Patent Application No. 60/060,440, filed Sep. 30, 1997.

FIELD OF THE INVENTION

The present invention is directed to a packing material apparatus for isolating and protecting an item, and is particularly directed to an apparatus which is lightweight, recyclable, easily assembled and easily broken down to a flat condition.

BACKGROUND OF THE INVENTION

In the packaging and transport of delicate items such as electronic equipment, various techniques are used to isolate the item from damage. Such damage often occurs during shipping and is beyond control of the manufacturer. Damage occurs due to shock, vibration, crushing of a shipping container, and/or intrusion through an exterior of the shipping container. The prior art has utilized such devices such as foamed elastomers/plastics and laminated paper/wood products to support the corners of the products. The synthetic products are difficult to recycle and generate static charges which can damage sensitive electronic items. The laminated products are heavy for their size and difficult to configure to adequately isolate the product from both shock and vibration.

SUMMARY OF THE INVENTION

The present invention provides an apparatus for protecting an article. The apparatus includes a single sheet of material folded to define a saddle portion recessed between two extending portions. The protected article is extendable into the saddle area. The two extending portions of the apparatus are defined by planar portions forming a triangular area when viewed from the side. The saddle area is defined by two triangular elements when viewed from the side and which are defined by planar portions.

BRIEF DESCRIPTION OF THE DRAWINGS

The foregoing and other features of the present invention will becomes apparent to one skilled in the art to which the present invention relates upon consideration of the following description of the invention with reference to the accompanying drawings, wherein:

FIG. 11 is an illustration of a second embodiment of the present invention;

FIG. 12 is a view taken along line 12—12 of FIG. 11;

FIG. 13 is a view taken along line 13—13 of FIG. 11;

DESCRIPTION OF PREFERRED EMBODIMENTS

Figure 1:
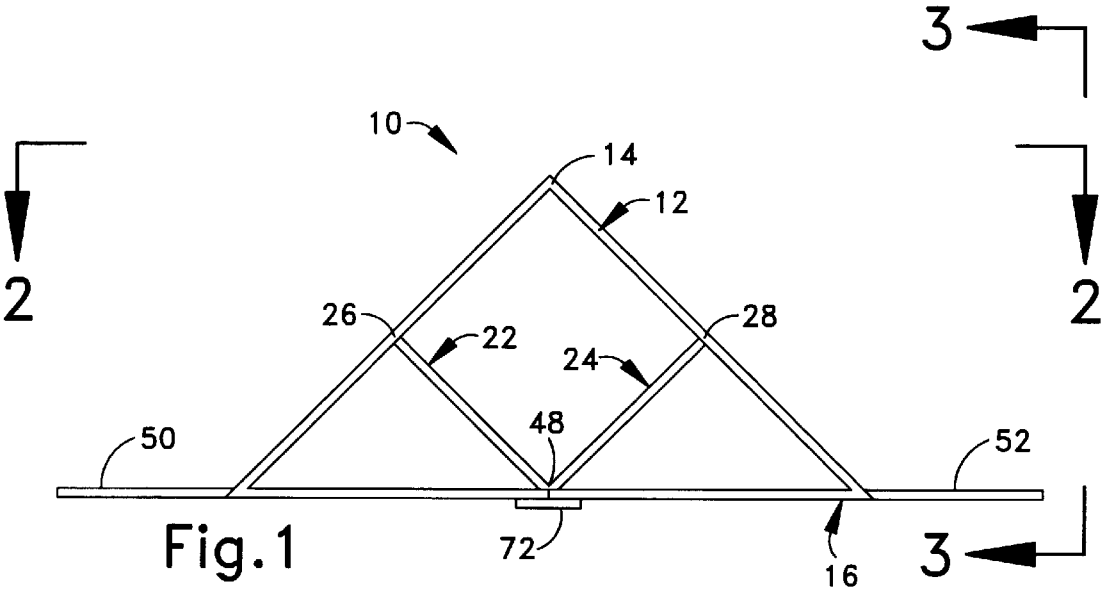
FIG. 1 is an illustration of an apparatus in accordance with the present invention.

An apparatus 10 in accordance with the present invention is illustrated in FIG. 1. The apparatus 10 is for protecting a shipped article against damage, such as from shock, vibration, crushing, etc. The apparatus 10 is comprised of a single sheet of material. Preferably, the material is a corrugated cardboard material which is readily recyclable.

Upon viewing the apparatus 10, three sets of triangular elements are visible. The first set has a singular triangular element 12 (FIGS. 1–3), which has an apex 14 located at a relatively large distance from a base 16. The second set has a second triangular element 18 (FIGS. 2 and 3) is similar to the first triangular element 12, in that its apex 20 is located at the same distance from the base 16. The second triangular element is located on the opposite side (see FIGS. 2 and 3) of the apparatus 10 from the first triangular element 12. Located in between the first and second triangular elements 12 and 18 is the third set, which comprises two smaller/shorter triangular elements 22 and 24. The triangular elements 22 and 24 each have their respective apex 26 and 28 located at a distance from the base 16 which is less than the distance to the apexes 14 and 20 of the triangular elements 12 and 18.

Figure 3:
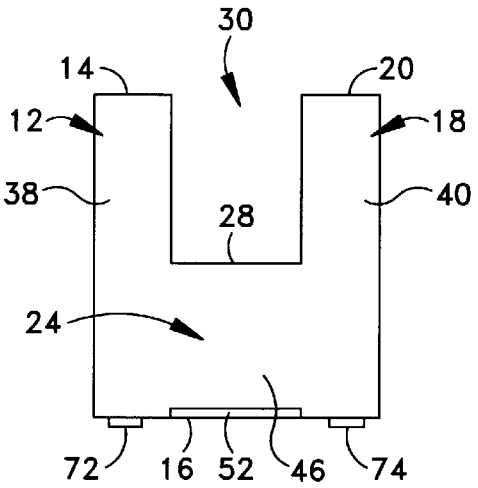
FIG. 3 is a view taken along line 3—3 in FIG. 1.

As shown in FIG. 3, the two large triangular elements 12 and 18 "bracket" the shorter triangular elements 22, 24 (triangular element 26 is hidden in FIG. 3). The triangular elements 12, 18, 22 and 24 form a saddle area 30 into which an item can extend.

Figure 2:
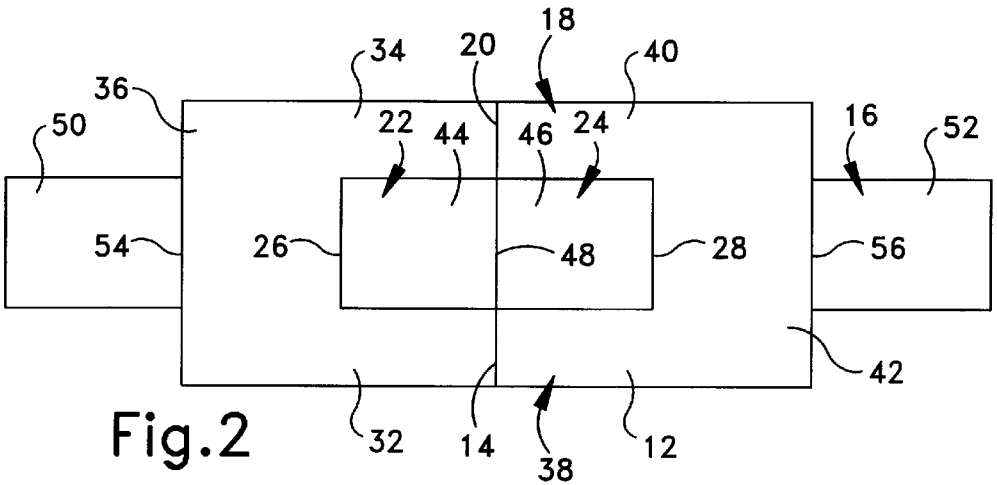
FIG. 2 is a view taken along line 2—2 in FIG. 1.

All of the triangular elements 12, 18, 22, and 24 are formed by segments of a unitary piece of material (e.g., the corrugated cardboard material). A first side 32 of the triangular element 12, a first side 34 of the triangular element 18, and a first side 36 of the triangular element 22 are coplanar and are all comprised of the same continuous segment of the material. This segment of the composite material forms a general C-shape, as viewed in FIG. 2. A second side 38 of the triangular element 12, a second side 40 of the triangular element 18, and a second side 42 of the triangular element 24 are coplanar and are all formed from the same planar segment of the material. This segment of the material forms a general backwards shaped C as shown in FIG. 2.

A second side 44, of the triangular element 22 is formed of its own segment of material which extends at a right angle (see FIG. 1) from the segment of material forming the sides 32, 34, and 36. The first side 46 (FIG. 2) of the triangular element 24 is formed of its own segment of material. The side 46 extends at a right angle (see FIG. 1) to the segment of material which forms the sides 38, 40, and 42.

The sides 44 and 46 are joined at a fold seam line 48. The fold seam line 48 is located "below" (as viewed in FIG. 1) the apexes 14 and 20 of the triangular elements 12 and 18. The side 44 is joined to the side 36 at the apex 26 which also forms its own fold line. The side 46 is joined to the side 42 of the triangular element 24 at its apex 28, and which also forms its own fold line.

The base 16 includes two, optional tabs 50 and 52. The tab 50 is attached to a "lower" (as viewed in FIG. 1) edge of side 36 of the triangular element 22 at a fold line 54. The tab 52 is attached to a "lower" (as viewed in FIG. 1) edge of the side 42 of the triangular element 24 at a fold line 56.

Figure 4:
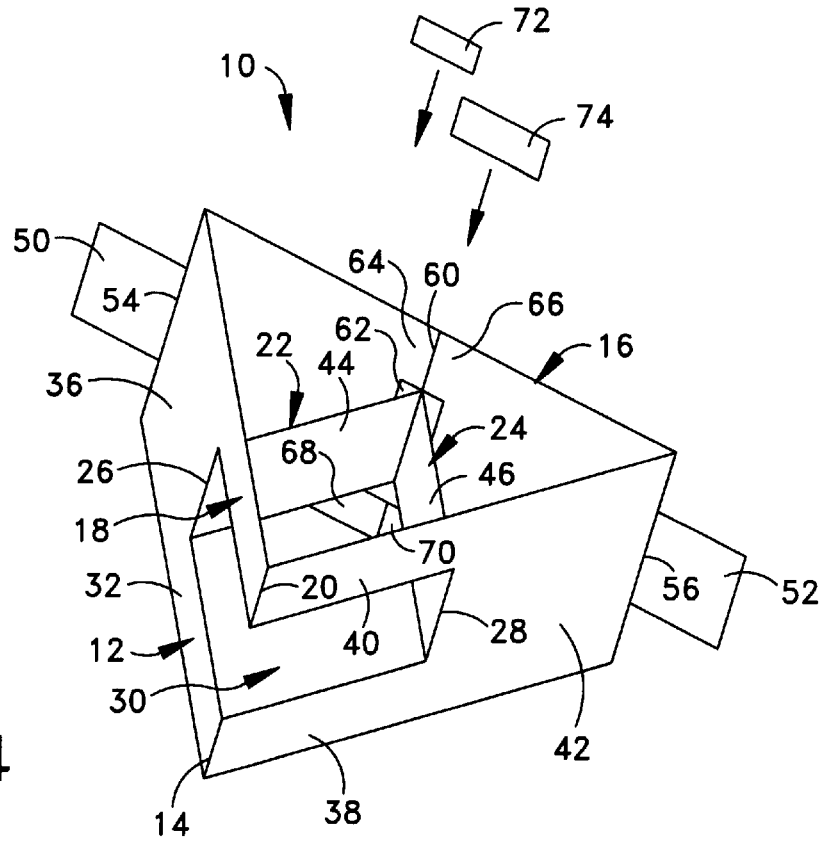
FIG. 4 is a perspective view of the apparatus.

The triangular elements 12, 18, 22, and 24, the saddle area 30, etc. of the apparatus 10 may more easily be viewed in the perspective view of FIG. 4. The perspective view of FIG. 4 is taken from a vantage point which is to the right and up from the viewpoint which one would have for FIG. 2. Also as seen best in FIG. 4, the base 16 has a seam 60 and a formed notch 62. The notch is sized such that the "lower" ends of the sides 44 and 46 (i.e., at fold line 48) of the triangular elements 22 and 24 fit into the slot 62. The seam 60 is comprised of tab elements 64 and 66, which abut "below" the apex 20 of the triangular element 18 and tab elements 68 and 70 which abut "below" the apex 14 of the triangular element 12. The junction of the tab elements 64, 66, and 68, 70 are held in place via adhesive tape strips 72 and 74 which are shown in FIG. 4 as being disjoint from the apparatus for illustrative purposes only.

Figure 5:
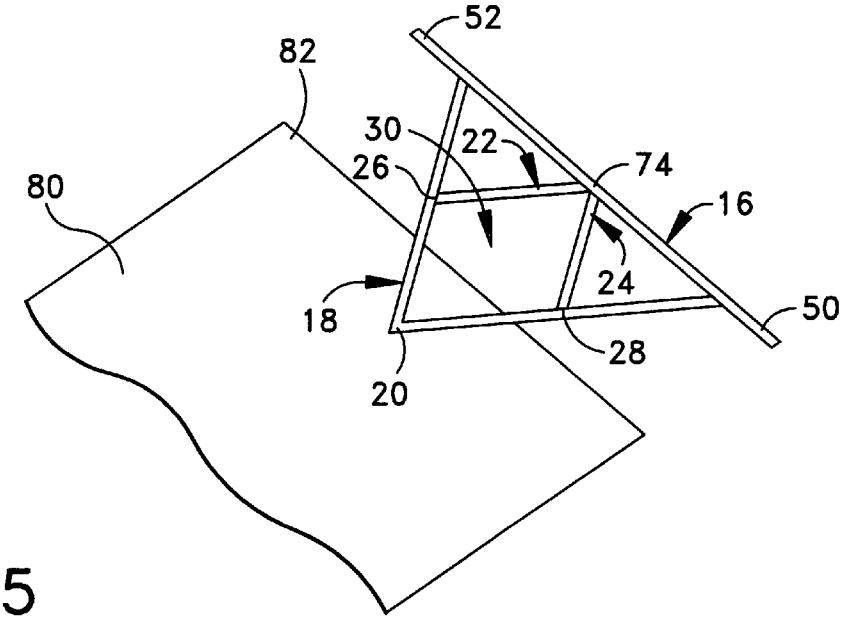
FIG. 5 is a view of the apparatus in a supporting position abutting a supported/protected item.

To now illustrate how an item 80 which is to be secured fits and is held by the apparatus 10, attention is directed to FIG. 5. In FIG. 5, a portion of the item 80 extends into the saddle area 30 of the apparatus 10. One side 82 of the item 80 abuts against the apexes 26 and 28 of the triangular elements 22 and 24, respectively. Also, the "upper" portion of the triangular element 18 is located on one side of the item 80 and the "upper" portion of the triangular element 12 (not visible in FIG. 5) is located on the opposite side of the item 80.

Figure 6:
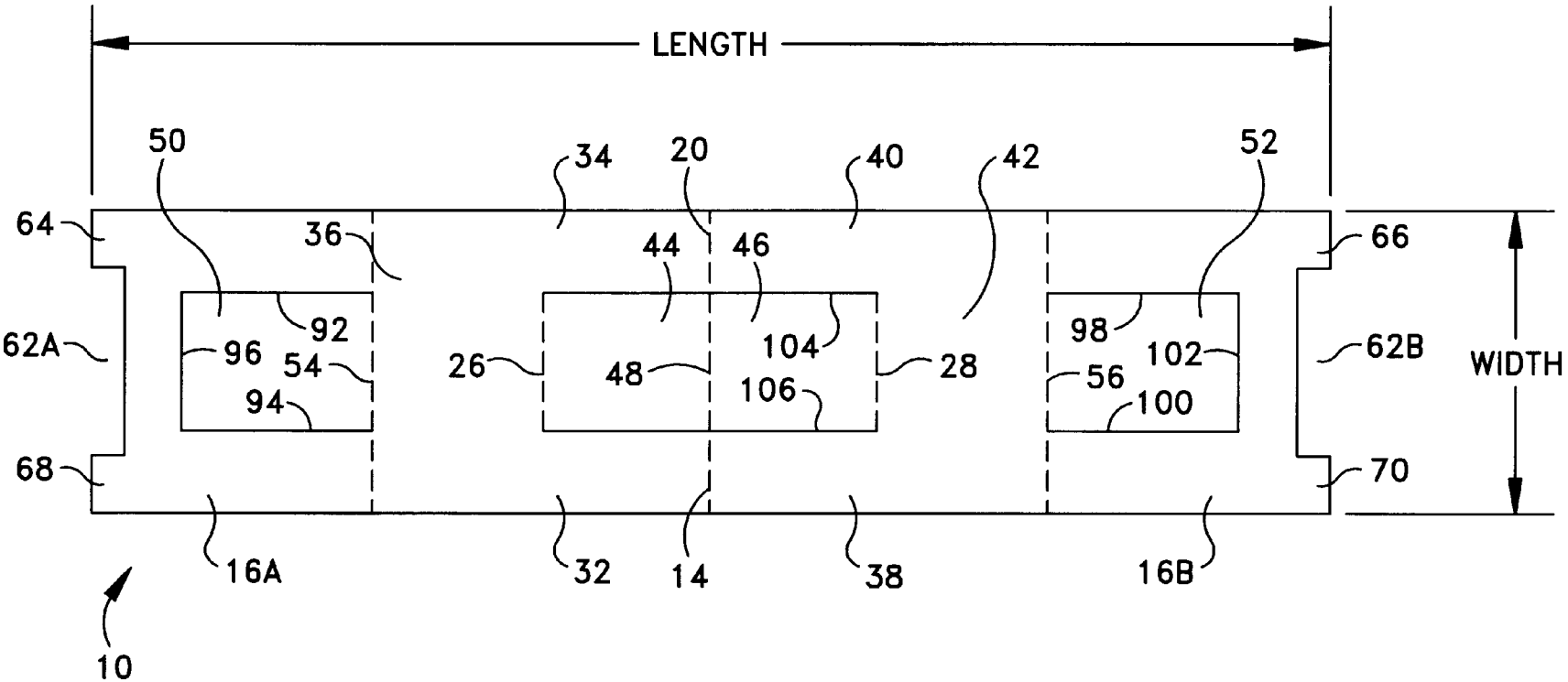
FIG. 6 is an illustration of the apparatus prior to folding and shows cut and fold lines.

Turning now to FIG. 6, an assembly process for the apparatus 10 will be appreciated. As shown in FIG. 6, the apparatus 10 starts out as a single, continuous piece of flat sheet material, i.e., corrugated cardboard. The single sheet of material has a length and a width. During the folding procedure, the width is not changed. However, the length of the finished apparatus is much less than its length in the unfolded condition. The sheet of material is prepared by cutting out a notch 62A to leave the tabs 64 and 68 on the one base section 16A (see the left-hand side of FIG. 6). Similarly, a notch 62B is cut out to leave the tabs 66 and 70 at the other base portion 16B (see the right-hand side of FIG. 6). It will be recalled that in the finished apparatus 10, the notch portions 62A and 62B will conjoin to form the slot 62, when tab 64 engages tab 66 and tab 68 engages tab 70.

Next, the tab 50 is cut from the base portion 16A. Specifically, two parallel cuts 92 and 94 are made in the lengthwise direction from the fold line 54. The cuts 92 and 94 extend from the fold line to a location spaced away from the notch 62A. A third cut 96 extends between the ends of the cuts 92 and 94. Accordingly, the tab 50 is a flap connected to the rest of the sheet material at the fold line 54. Further, the tab 50 is the portion of the material which initially was the center portion of the base portion 16A.

Similarly, the tab 52 is cut from the base portion 16B. Two parallel cuts 98 and 100 extend in the lengthwise direction from the fold line 56 toward the notch 62. The cuts 98 and 100 extend to a distance spaced away from the notch 62B. A cut 102 extends between the end of the cuts 98 and 100. Accordingly, the tab 52 is connected to the rest of the sheet material at the fold line 56 and is separable from the base portion 16B.

It will be appreciated that in the flat condition, the apexes 14, 20, 26, and 28 are foldlines. In order to form the triangular elements 22 and 24, two cuts 104 and 106 are made into the sheet material. Specifically, the cuts 104 and 106 extend in the lengthwise direction across the line connecting the foldlines (in the flat condition) 14, 48, and 20. The cut 104 extends from the center of the flat material (i.e., at foldline 20), to a location which is one-half the length of the side 34. The terminus of the cut 104 on the left side is at the foldline 26. The cut 104 similarly extends to the right, as viewed in FIG. 6, halfway along the side 40 and terminates at the foldline 28.

The cut 106 extends parallel to the cut 104. The cut 106 extends across the center fold area (i.e., folds 14, 48, and 20) and terminates at the foldline 26 and also terminates at the foldline 28. With the cuts 104 and 106, the sides 48 and 46 (which form part of the triangular elements 22 and 24) are separable from the sides 34 and 40 of the triangular portion 18, and are also separable from the sides 32 and 38 which form the triangular portion 12.

Figure 7:
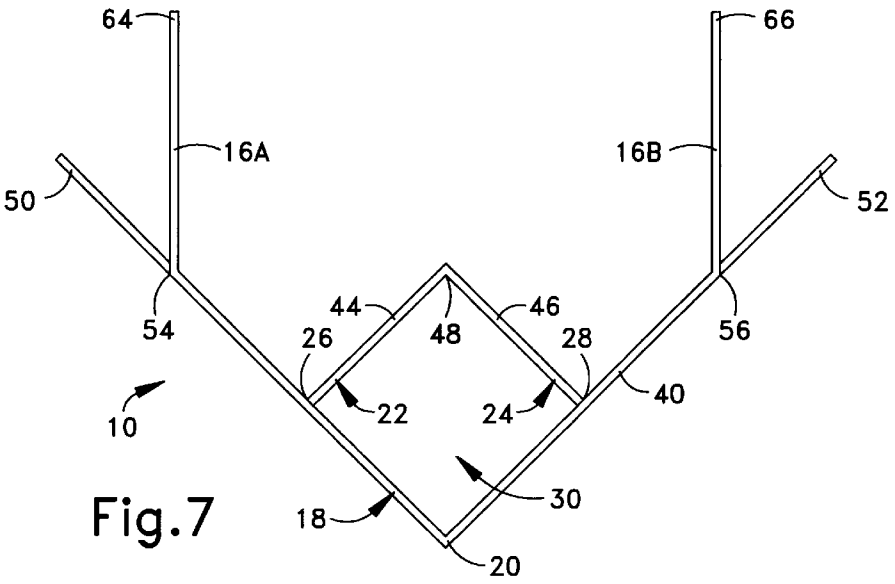
FIG. 7 is a view of the apparatus during a step of a folding procedure.

To begin the folding process (see FIG. 7), the base portion 16A is folded (upward, as viewed in FIG. 7) away from the tab 50. Similarly, the base portion 16B is folded (upward as viewed in FIG. 7) away from the tab 52. The foldline 48 and the foldlines 14 and 20 (foldline 14 not visible in FIG. 7) are simultaneously folded and moved away from each other. Specifically, foldline 48 is moved in the same direction as the base portions 16A and 16B (upward as viewed in FIG. 7). Foldlines 20 and 14 are moved downward as viewed in FIG. 7. Simultaneously with the folding of foldlines 14, 48, and 20, folds occur at foldlines 26 and 28.

The foldlines 48 and 14/20 are moved away from each other until the foldlines 14/20 form the apex of a right angle (i.e., sides 34 and 40 are perpendicular, and sides 32 and 38 are perpendicular). At this same time, the foldline 48 forms an apex of a right angle (i.e., sides 44 and 46 are perpendicular). Further, at this time, foldlines 26 and 28 form apexes of respective right angles. For foldline 26, the sides 36 and 44 of the triangular portion 22 are perpendicular. For the foldline 28, the sides 42 and 46 of the triangular portion 24 are perpendicular to each other.

Figure 8:
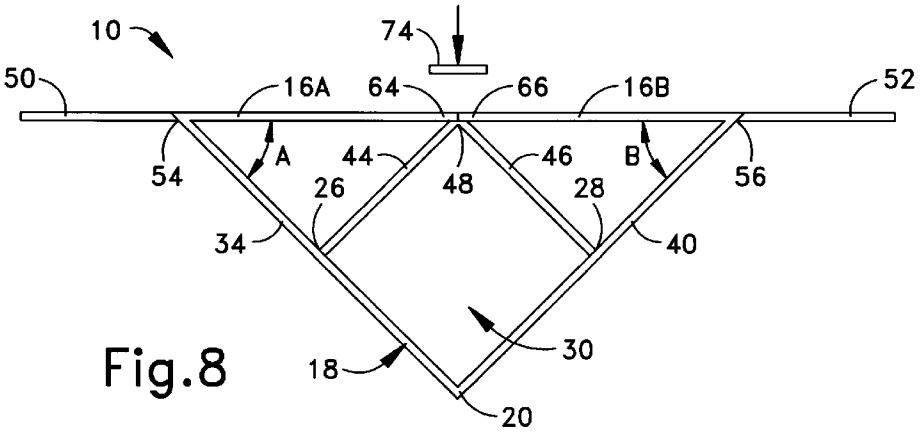
FIG. 8 is a view similar to FIG. 7, but shows a final step of the folding procedure.

Next, as viewed in FIG. 8, the base portion 16A is further folded toward the foldline 48. Also, the base portion 16B is also folded toward the foldline 48. The base portions 16A and 16B are moved to engage the foldline 48 in their respective notches 62A and 62B, which know form the slot 62. The base portion 16A forms an arcuate angle A with the side 34 of the triangular portion 18 as shown in FIG. 8. Similarly, the base portion 16B forms an arcuate angle B with the side 40. The base portions 16A and 16B now form the base 16 with the tab 64 abutting the tab 66 and the tab 68 abutting the tab 70 (tabs 68 and 70 not shown in FIG. 8). The base portions 16A and 16B are now generally perpendicular to the tabs 50 and 52. To complete the assembly procedure, the adhesive tape strip 72 is applied across the tabs 68 and 70 (not shown in FIG. 8). The adhesive tape strip 74 is applied across the tabs 64 and 66. The apparatus 10 is now rigid and cannot be unfolded until the strips of adhesive tape 72 and 74 are removed.

Figure 9:
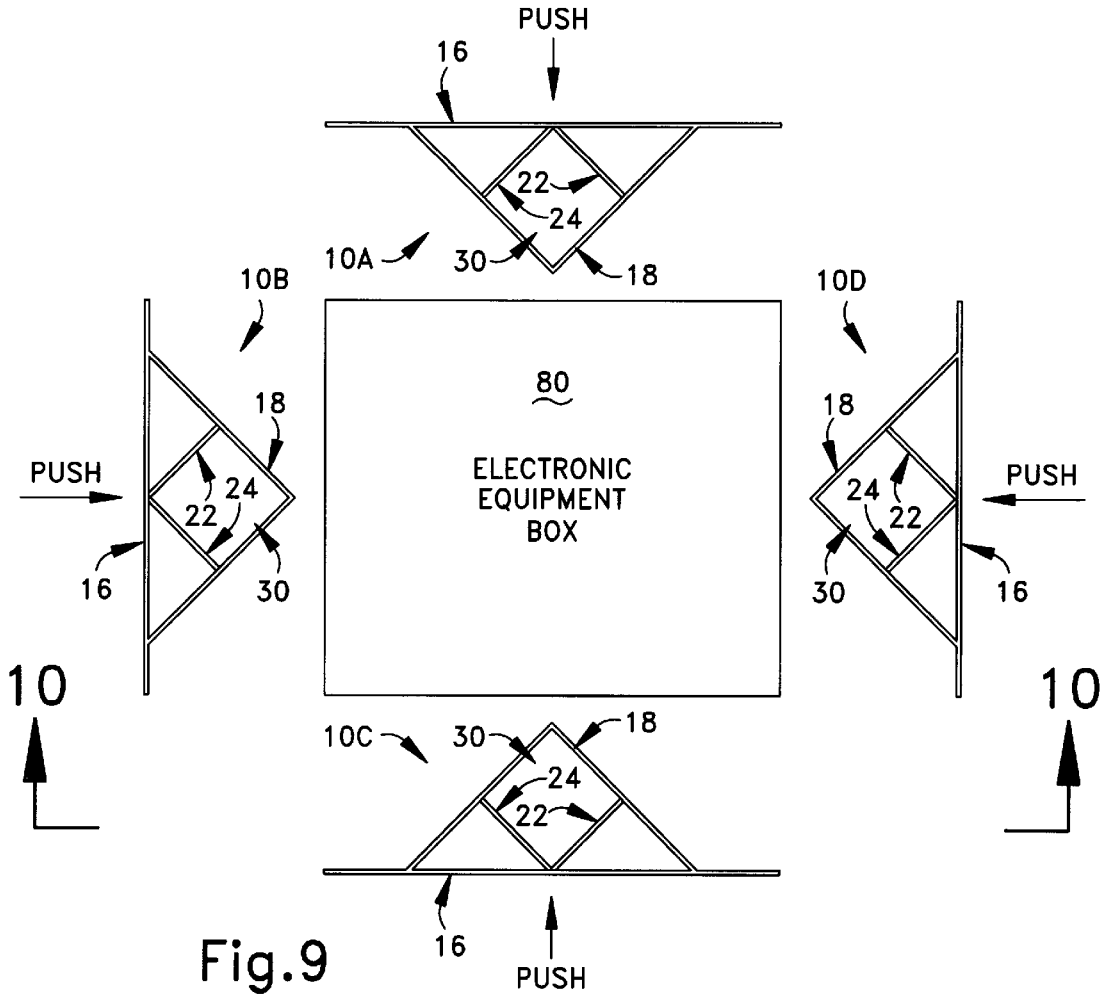
FIG. 9 is a view of the supported/protected item with four of the apparatus accordingly to the present invention being applied during a packing procedure.
Figure 10:
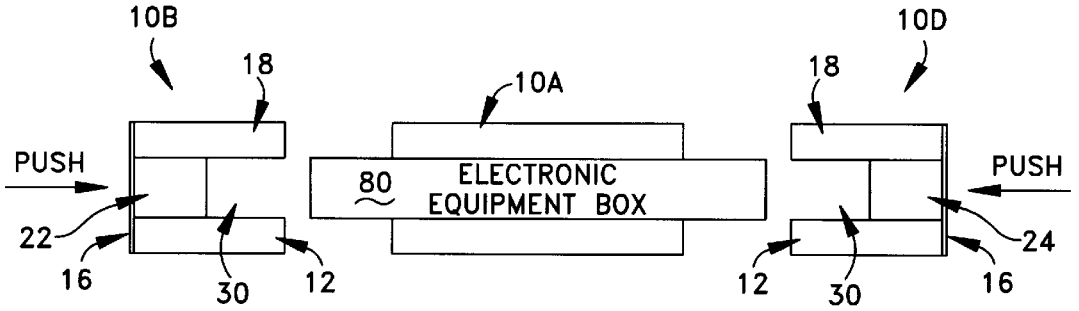
FIG. 10 is a view taken along line 10—10 of FIG. 9.

In order to package the item 80 (which is illustrated in FIGS. 9 and 10 as an electronic equipment box), the item 80 is "surrounded" by a number of the apparatus 10 of the present invention. The example packing shown in FIGS. 9 and 10 utilizes four of the apparatus 10. The several apparatus are labeled 10A–10D. The item 80 and each of the apparatus 10A–10D are matched in size such that the item 80 fits snugly into the saddle 30. The several apparatus 10A–10D are "secured" to the item 80 by pushing (indicated by push arrows) the respective apparatus onto the item 80 such that the item 80 extends into the respective saddle 30.

With the several apparatus 10A–10D located on the item 80, the assembly of the item 80 with its several packing apparatus 10A–10D properly located, can be located within a shipping box or container (not shown in FIGS. 9 and 10).

A second embodiment in accordance with the present invention is illustrated in FIG. 11. The apparatus 200 of the second embodiment has certain similarities to the first embodiment described above. Specifically, the apparatus 200 has triangular elements which form saddles. The apparatus 200 of the second embodiment differs from the first embodiment in than the second embodiment has two groups of triangles, each group forming its own saddle.

Specifically, as shown in FIG. 12, the apparatus 200 includes large triangular portions 212 and 218. The triangular portion 212 includes side portions 232 and 238 which meet at an apex 214. The triangular portion 218 includes wall sections 234 and 240 which meet at an apex 220. The triangular portions 212 and 218 "bracket" triangular portions 222 and 224. The triangular element 222 includes wall portions 236 and 244. The triangular section 224 includes wall portions 246 and 242.

The wall sections 232, 234, and 236 are continuous, are coplanar, and form a general C-shape. Similarly, the wall sections 238, 240, and 242 are also continuous and coplanar, and form a general backward C-shape. The wall section 244 extends perpendicular to the wall sections 232, 234, and 236. Similarly, the wall section 224 extends perpendicular to the wall sections 238, 240, and 242. The wall sections 244 and 246 are joined to be perpendicular at a fold 248. The wall section 222 is connected to the wall section 236 at fold 226 which forms the apex of the triangular portion 222. The wall section 242 is connected to the wall section 246 by the fold 228 which forms the apex of the triangular element 224. The fold 248 is located "below" the apex 214 and 220 of the large triangular portions 212 and 218, as viewed in FIG. 11.

The second group of triangular elements has similar segments which are identified with identical numbers, but which include a prime. The two triangular sections are connected at a foldline 255. Specifically, the wall portions 238, 240, and 242 of the first group of triangular elements (left-hand group as viewed in FIG. 11) is connected to the wall section 232', 234', and 236' of the second set of triangular elements. Each group of triangular elements forms a saddle. The saddle 230' is illustrated in FIG. 13 for the second set of triangular elements.

Extending under both sets of triangular elements is a base 216. The base 216 is connected on the lefthand side, as viewed in FIG. 11, at a foldline 254. The base 216 is connected on the righthand side by a foldline 256. The base 216 is comprised of base elements 216A and 216B which are connected via strips of adhesive tape 272 and 274 beneath the foldline 255, as will be explained in further detail below.

Figure 14:
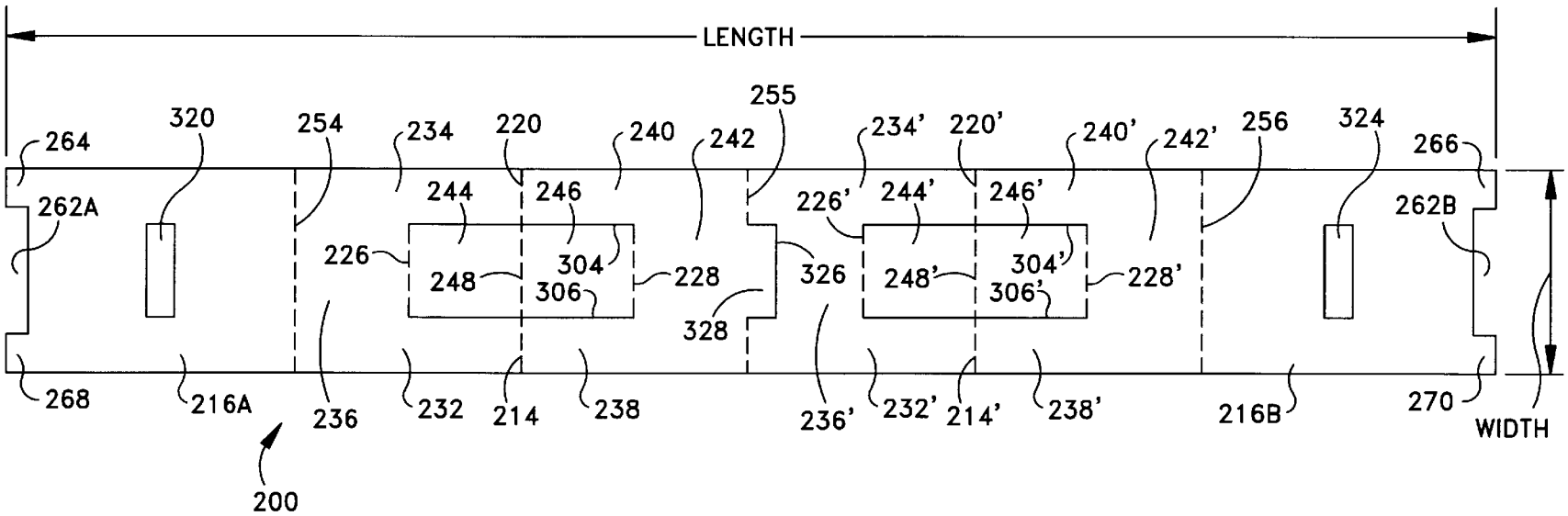
FIG. 14 is an illustration of the second embodiment prior to folding and shows cut and fold lines.

Similar to the first embodiment, the second embodiment is made from a single, flat sheet of material. Preferably, the material is corrugated cardboard. FIG. 14 shows such a piece of material in a prefolded condition. FIG. 14 also illustrates certain other structural elements of the device. Specifically, two notches 262A and 260B are illustrated. These notches conjoin to form a slot 262 as will be described later. A slot 320 is cut in the base portion 216A such that its major axis extends along the widthwise direction. Similarly, a slot 324 is cut in the base portion 216B. A notch cut 326 is cut to create a tab 328, at and adjacent to, the foldline 255.

Further, similar to the first embodiment, cuts 304 and 306 are provided in a direction perpendicular to the lengthwise extent of the sheet to define the wall portions 244 and 246. The cuts 304 and 306 extend perpendicularly across the foldline area of 214, 248, 220 and terminate at the foldlines of 226 and 228. Similarly, at the portion designated with prime numerals, cuts 304' and 306' extend across the foldline area of 214', 248', and 220', and terminate at the foldlines 226' and 228'.

Figure 15:
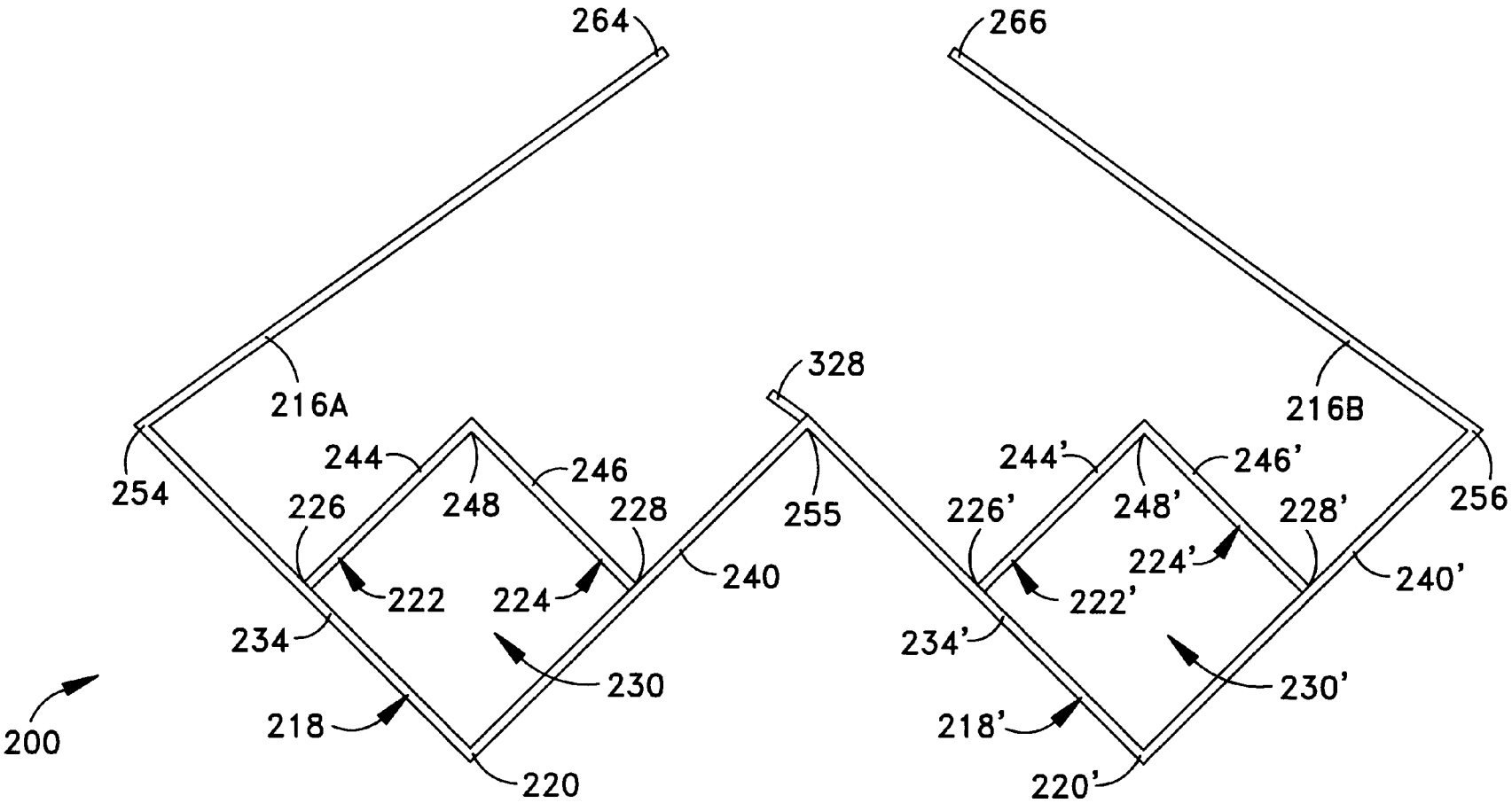
FIG. 15 is a view of the second embodiment during a step of a folding procedure.
Figure 16:
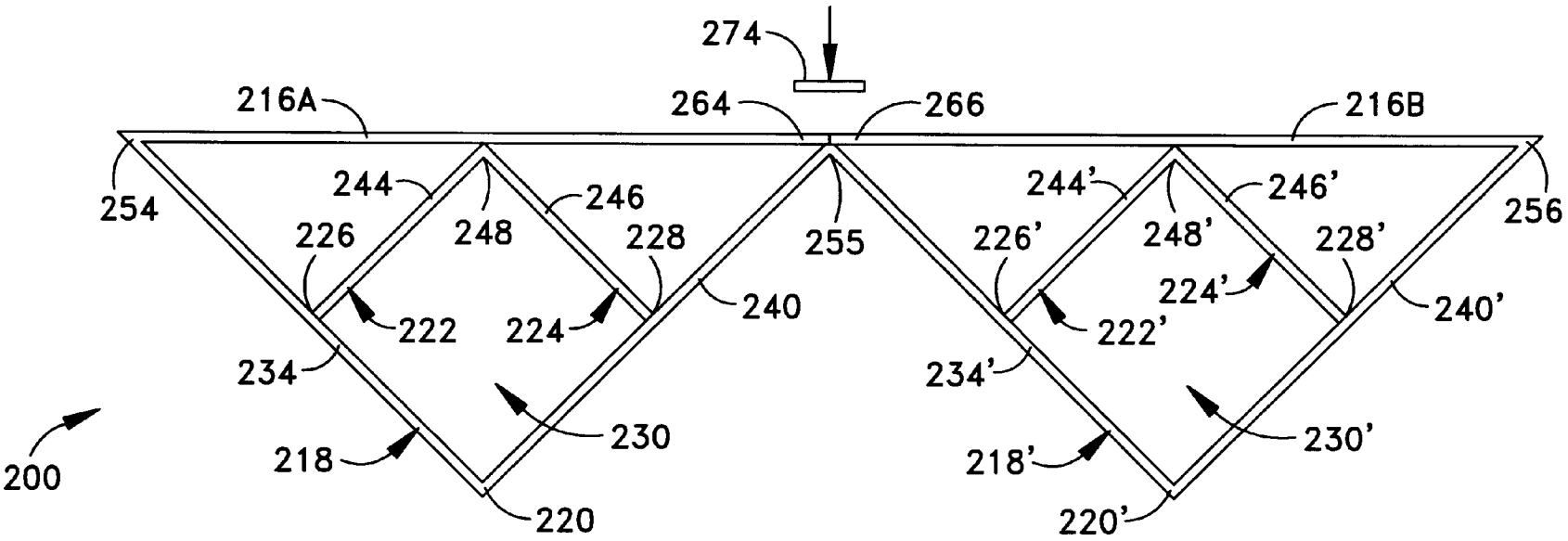
FIG. 16 is a view similar to FIG. 15, but shows a final step of the folding procedure.

In order to begin the folding process of the second embodiment, folds are initiated as shown in FIG. 15. Specifically, the foldlines 248 and 220/214 are moved away from each other and simultaneously folded. This folding action also causes the folds 226 and 228 to appear. The base portion 216A is folded at the foldline 254 to move the tabs 264 and 268 (tab 268 not visible in FIG. 15) toward the foldline 255. Similarly on the righthand side (as viewed in FIG. 15), folds 214', 220', 248', 226', 228', and 256' are created. Also, the tab 328 is punched out from its cut 326. The material is folded at the foldline 256 such that the portions of the material 238, 240, 242 face the portions of material 232', 234', and 236' (i.e., the apexes 214, 214', 220, 220' point in the same direction). In order to complete the folding, the tab 264 is brought into abutment with the tab 266, and the tab 266 is brought into abutment with the tab 270. The tab 328 extends through the slot 262 (defined by the notch portions 262A and 262B). The portion at the fold 248 extends into the slot 320 and the portion at fold 248' extends into the slot 324. To complete the assembly, the strips of adhesive tape 272 and 274 are applied to extend across the respective tabs 264, 266, 268, and 270.

Figure 17:
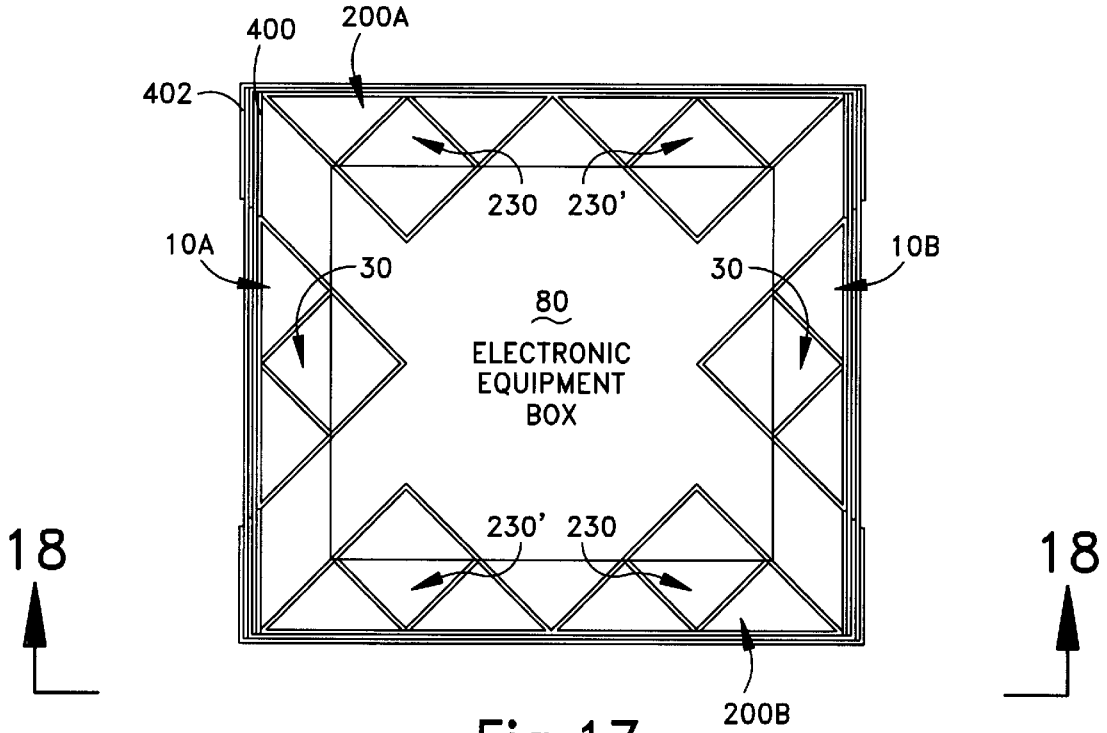
FIG. 17 is a view illustrating a shipping container containing the supported/protected item and illustrating use of both of the first and second embodiments of the present invention to isolate the item within the container.
Figure 18:
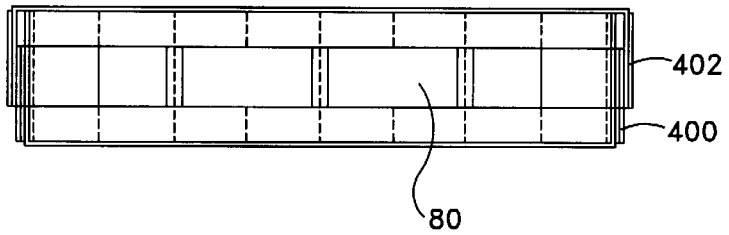
FIG. 18 is a view taken along line 18—18 in FIG. 17.

Similar to the first embodiment, the second embodiment is used to secure and protect a delicate item. The item is located to extend within the saddles 230 and 230'. Moreover, the second embodiments may be used in conjunction with the first embodiment to protect items which are delicate. For example, as shown in FIGS. 17 and 18, two of the apparatus 10 of the first embodiment (identified by the numerals 10A and 10B) and two of the apparatus 200 of the second embodiment (identified by the numerals 200A and 200B) are used to protect the item 80. Specifically, the apparatus 10A abuts the leftside of the item 80, with a portion of the item extending into the saddle 30 of the apparatus 10A. Similarly, on the righthand side, as viewed in FIG. 17, the portion of the item 80 extends into the saddle portion 30. Above and below (as viewed in FIG. 17), portions of the item 80 extend into respective saddles 230 and 230' of the apparatus 200A and the apparatus 200B. All of this is located within a box 400 which is then enclosed by a lid 402.

From the above description of the invention, those skilled in the art will perceive improvements, changes and modifications. Such improvements, changes and modifications within the skill the of the art are intended to be covered by the appended claims.

Having described the invention, the following is claimed:

1. An apparatus for protecting an article, said apparatus comprising a single sheet of material folded to define a saddle area recess between extending portions and a base portion, the protected article being extendable into the saddle area, the extending portions include planar portions extending from the saddle area to the base portion forming triangular elements when viewed from the side, the saddle area being defined by the recess and the triangular elements.

2. An apparatus as set forth in claim 1 wherein the planar side portions of the extending portions and at least one of the triangular elements defining the saddle area are coplanar.

3. A packing arrangement adapted for receiving an item to be packaged comprising:

a container having a top, bottom and sides and having a size that is larger than the item; and an inner support means adapted to be inserted within the container, the inner support means being shaped to extend along the sides of the container and includes side portions urging against the sides of the container and includes generally V-shaped mounting portions separate away from the sides of the container, the V-shaped mounting portions being formed with apertures therein shaped to be adapted for receiving and supporting portions of the item to be packaged within the container relative to the top and bottom of the container, the V-shaped mounting portions include a generally V-shaped internal element extending from the aperture to the side portion forming added support structure with the V-shaped mounting portions for engaging the item to be packed relative to the sides of the container, so that when the inner support means is inserted within the container with portions of the item included in the V-shaped mounting portions, the item is shock mounted relative to the top, bottom and sides of the container.

4. A packing arrangement as defined in claim 3 wherein the container has a generally rectangular shape, and the inner support means includes separate V-shaped mounting portions along the four sides of the container.

5. A packing arrangement as defined in claim 4 wherein the inner support means comprises of a plurality of unitary units for supporting separate portions of the item to be packaged, each unitary unit includes a side portion and at least one V-shaped mounting portion.

6. A packing arrangement as defined in claim 5 wherein the V-shaped internal element has its apex extending away from the V-shaped mounting portion and engages the side portion.

7. A packing element for supporting an item to be packed comprising:

a first planar generally triangular unit having first, second and third planar sides, and having a slot formed in the second and third sides for receiving the item to be packed, the slot extending from the junction of the second and third planar sides toward the first planar side; and at least a fourth planar side extending from one of the second and third planar sides to the first side unit to define a second triangular shape including the portions of the first side, the fourth side and portions one of the second and third sides with an apex located adjacent one end of the slot, the arrangement being such that the portion of the second and third sides adjacent the slot and said apex form a mounting arrangement for receiving the item to be packed.

8. A packing element as defined in claim 7 wherein a fifth planar sides extending from other of second and third sides to the first side to define a third generally triangular shape including the portions of the first and fifth sides and the other side with an apex adjacent the other end of the slot, the arrangement being such that the portion of the second and third sides adjacent the slot and said apex of the first and second triangle shapes form a mounting arrangement for receiving the item to be packed.

9. A packing element as defined in claim 8 wherein the packing element is formed of a single sheet of material cut and scored and cut for assembly as a unitary packing element.

10. A packing element as defined in claim 9 wherein:

the single sheet of material includes first, second and third scores for folding the sheet of material into the first triangular unit;

the second and third sides include first and second cuts respectively extending between the second and third sides and across the apex between the second and third sides; and the second and third sides include the fourth and fifth scores at the end of the cuts and a sixth score at the apex that define the fourth and fifth sides for folding the fourth and fifth sides so as to form the slot and second and third triangle shapes.

11. A packing element as defined in claim 10 wherein the first side is formed with an aperture for receiving the junction of the fourth and fifth sides to control the movement of the junction.

* * * * *